US005473780A

United States Patent [19]

Zen

[11] Patent Number: 5,473,780

[45] Date of Patent: Dec. 12, 1995

[54] BODY SUIT WITH DROP SEAT FLAP

[76] Inventor: Su Zen, 55 Bethune St., New York, N.Y. 10014

[21] Appl. No.: 397,980

[22] Filed: Mar. 3, 1995

[51] Int. Cl.[6] ..... A41D 1/06; A41D 1/00

[52] U.S. Cl. ..... 2/79; 2/78.2; 2/80; 2/227

[58] Field of Search ..... 2/78.2, 79, 80, 2/227

[56] References Cited

U.S. PATENT DOCUMENTS

| | | | |
|---|---|---|---|
| D. 44,604 | 9/1913 | Blain | 2/78.2 X |
| 1,111,975 | 9/1914 | Smith | 2/78.2 |
| 1,504,932 | 8/1924 | Boehmer | 2/79 |
| 1,799,336 | 4/1931 | Walser | 2/79 X |
| 2,389,273 | 11/1945 | Novak | 2/227 |
| 3,806,953 | 4/1974 | Kalil | 2/227 |
| 4,457,025 | 7/1984 | Meryash | 2/79 |
| 4,607,396 | 8/1986 | Craig | 2/79 |
| 5,163,182 | 11/1992 | Fiveash | 2/80 X |

*Primary Examiner*—C. D. Crowder
*Assistant Examiner*—Shirra L. Jenkins
*Attorney, Agent, or Firm*—Eliot S. Gerber

[57] ABSTRACT

A one-piece body suit (cat suit or jump suit or romper) has a rear drop-seat portion. That portion is formed with a central panel and two opposite triangular panels extending therefrom which cross each other at the front of the garment. Fastener ends at the ends of the triangular panels are removably fastened at the back of the wearer.

4 Claims, 2 Drawing Sheets

BODY SUIT WITH DROP SEAT FLAP

BACKGROUND OF THE INVENTION

1. Field of the Invention

The present invention relates in general to garment designs for women and children's "body suits" and "cat suits", both of which are tight-fitting one-piece garments.

2. Description of the Prior Art

In the case of most types of body suits and cat suits, it is necessary when using bathroom facilities, or toilet, to remove the whole garment and have it hanging at the wearer's ankles on the floor. This is inconvenient, unsanitary, time consuming and very impractical.

In U.S. Pat. No. 4,607,396 to Craig a one-piece type garment has "a concealed seat panel integrally formed with a waistband to conceal the seams" . . . "to permit comfortable easy use of restroom facilities". U.S. Pat. No. 4,457,205 to Meryash shows a jump suit "with a rear drop-seat panel that opens downwardly . . ." In U.S. Pat. No. 5,014,356 to Tomasi-Dubois a jumpsuit has a dropseat "with attached side tabs for fastening". U.S. Pat. No. 679,572 to Pennington discloses a "combination undergarment", namely, a "union suit" having a rear opening with flaps. Union suits of other types are shown in U.S. Pat. Nos. 1,092,900 to E. H. Davison et al; 1,099,755 having a dropseat with straps which may "be tied together"; 1,182,386 to Kline and 1,529,629 to Godbehere. In addition, other prior art patents show garments having drop-seat panels, namely, U.S. Pat. Nos. 1,485,793 to McKee; 1,967,233 to Fellroth, in which the drop seat is secured by a belt; and 2,611,132 to Moeller having "a drop seat panel formed out of the trouser portion".

SUMMARY OF THE INVENTION

The principal object of the present invention is to provide an improved one-piece garment for body wear in which the seat flap is readily opened and refastened without having to remove most of the garment.

"THE CAT WRAP", which is the applicant's trademark for the garment of the present invention, is a one-piece body suit which covers the wearer's legs, torso and arms. In the back a seat flap is constructed so that it can be lowered to enable a woman to use the toilet without removing the garment. The seat flap tapers as it wraps, overlaps and crisscrosses around the front of the garment over the stomach area and becomes a waist band. The waist band connects and is secured with a hook and loop type of self-gripping fastening material such as, for example, that sold under the registered trademark "VELCRO" (brand). The two strips of VELCRO stick when pressed together, and with some effort may easily be pulled apart. The body suit ("CAT WRAP") is closed when the first and second strips of VELCRO are mated together.

The crisscrossing of the waist band in the front of the garment, over the stomach of the wearer, is a fashion feature. The panels of the waistband, i.e., the panels of the crisscross. form a "tummy tuck" which is flattering to the wearer.

BRIEF DESCRIPTION OF THE DRAWINGS

Other objects and features of the present invention will be apparent from the following detailed description taken in conjunction with the accompanying drawings. In the drawings.

DETAILED DESCRIPTION

Figure 1:
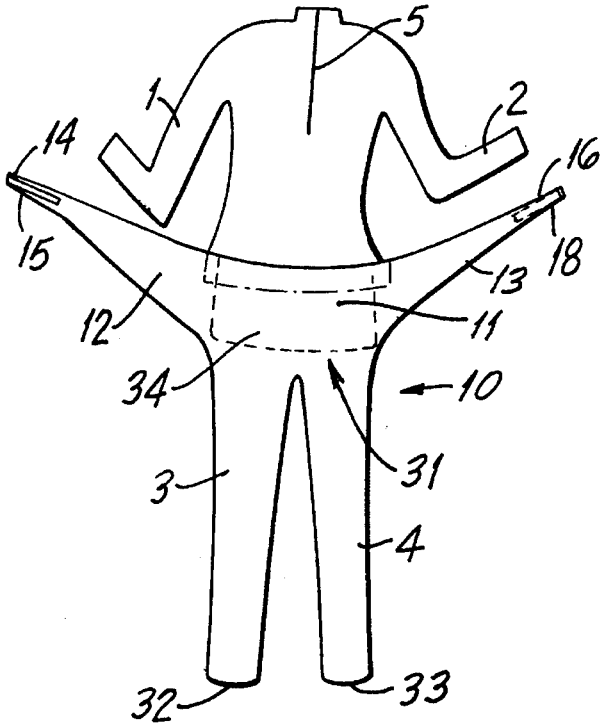
FIGS. 1, 2 and 3 are back elevation views of the back of the garment of the present invention.

The garment 10 of the present invention is a "body suit" or "cat suit" or "romper" or "jump suit" which is a one-piece garment formed from stretchable fabric; for example, the fabric is woven from a blend of fibers of rayon and Lycra (™ brand of DuPont for spandex) or blends of cotton or wool with spandex. A typical garment has about 2.5 yards of fabric. The garment 10 has sleeves 1,2, legs 3,4 and a zipper 5 or other closure at its back. The legs 3,4 have a joined upper portion 31 and free bottom ends 32,33.

FIG. 1 shows the back view of the garment 10 with the seat flap 11 up and open. The long waist bands 12 and 13 are integral with and narrowingly extend outward from the seat flap 11. On the far left, a piece of VELCRO (™) 14 is sewn or secured onto near the free end of the waist band 12. VELCRO (™) is a type of interlocking fabric.

Figure 2:
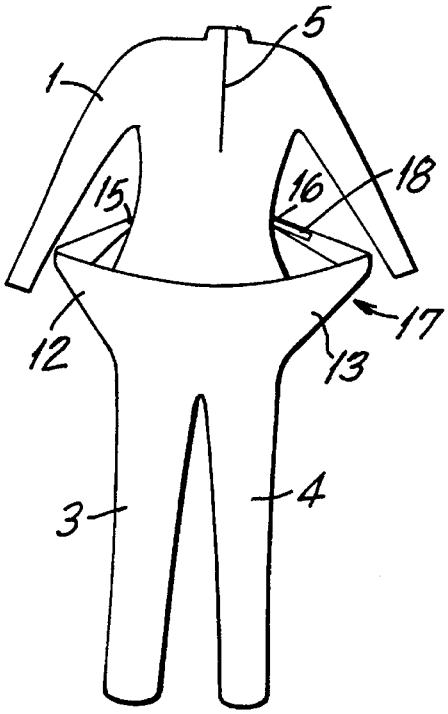

FIG. 2 shows the back view of the garment 10 with the two ends 15,16 of the waist band 17 wrapping around the garment at the waist area. On the inside of the right waist band 13 is attached a piece of VELCRO (™) 18.

Figure 3:
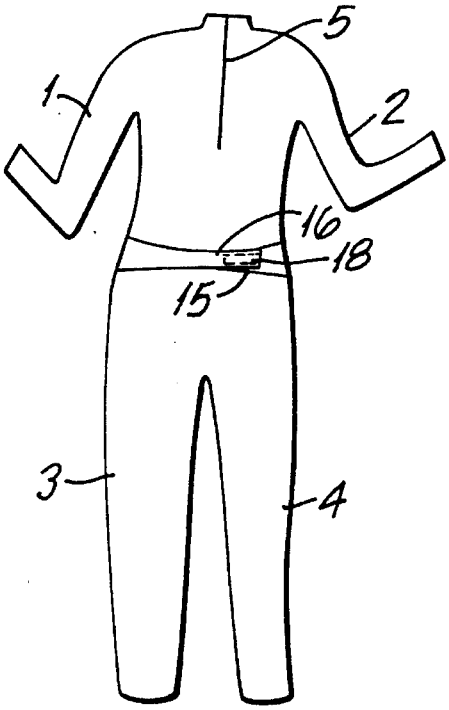

FIG. 3 shows the back view of the garment with the two ends 15,16 of the waist band 17 attaching in the back. The garment is closed when the two strips 14,18 of VELCRO (™) at each respective end 15,16 of the waist band 17 are pressed together.

Figure 4:
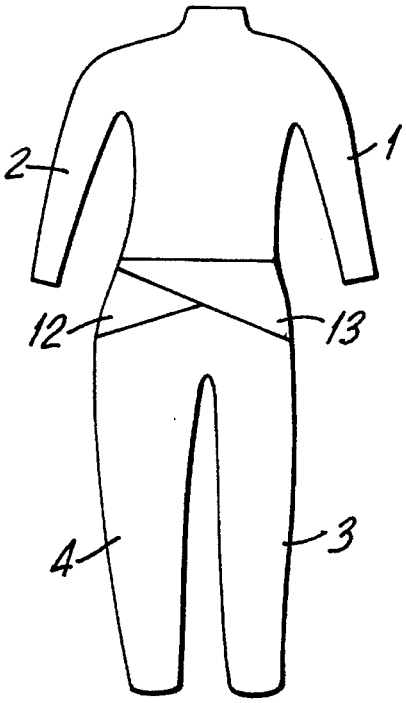
FIG. 4 is a front elevation view of the garment of FIGS. 1–3.

FIG. 4 shows the front view of the garment when it is closed and being worn. The two triangular panels 12,13 extending from the seat flap wrap 11, overlap and crisscross in the front of THE CAT WRAP (™) over the stomach area.

Figure 5:
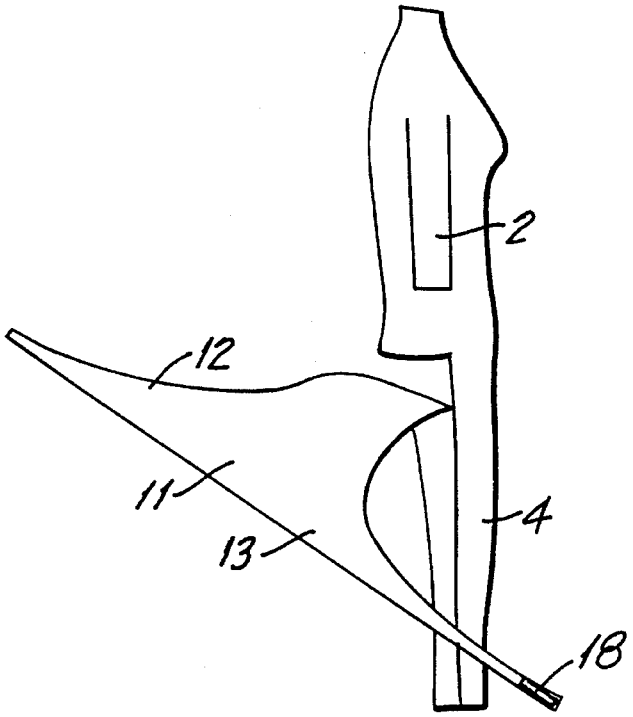
FIGS. 5 and 6 are side elevation views of the garment of FIGS. 1–3.
Figure 6:
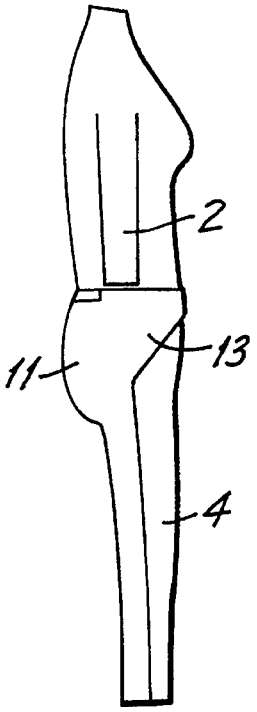

FIG. 5 shows the side view of the garment with the seat flap 11 coming down from the back of the pants part of the garment. The seat flap 11 extends and becomes the waist band. On the far right side of the waist band the fastener 18 at the edge of the waist band is VELCRO.

The garment 10, as integral portions thereof, has a seat-flap (drop-seat panel) 11, indicated by dash-dash lines in FIG. 1. The dash-dash lines are not physical lines of the garment but rather an imaginary line used in FIG. 1 to illustrate the different panels of the garment. The dash-dot-dash lines show the shape of the lower edge of the back of the garment. The panel has its lower edge 34 integral with, and connected to, the joined upper portion 31 of the legs 3,4. The triangular panels 12,13 extend from drop-seat panel 11 and have their free ends (corners) extending to form a belt-like waist band 17 whose ends 15,16 attach in the back. The triangular panels 12,13 cross each other in the front of the garment (crisscross), as shown in FIG. 4, to provide an attractive frontal appearance, i.e., a fashion feature.

Modifications may be made in the present invention within the scope of the claims. For example, the garment shown in the attached drawings used a zipper closure; however, other types of closures, or an opening, may be used in its place. The illustrated garment has long sleeves, but the present invention may be used with short sleeve garments. "THE CAT WRAP" may be used, for example, with a sweater or shawl for dress wear and may be worn for sports, including exercise, ski wear, etc.

I claim:

1. A one-piece coverall garment adapted to be tightly fitted on the body of a wearer and having a front and a rear, the garment being of fabric and having, as integral portions thereof, two arm sleeves and two legs having free bottom ends and a joined upper portion, characterized in that the garment further comprises as integral portions thereof a drop-seat panel having a lower edge connected to the leg's upper portion, two triangular shaped panels extending from the drop seat panel at opposite sides thereof and crossing each other at the front of the garment, and fastener means extending from each of the triangular panels long enough to be removably fastened together at the rear exterior of the garment.

2. A garment as in claim 1 wherein the fastener means is an interlocking fabric panel.

3. A garment as in claim 1 wherein the triangular panels each have a corner not connected to the drop seat panel and the said corners are connected to belt-like extensions integral with the triangular panels and the fastener means are secured to the belt-like extensions.

4. A garment as in claim 1 wherein the fabric is woven from a spandex blend of fibers.

* * * * *

UNITED STATES PATENT AND TRADEMARK OFFICE

CERTIFICATE OF CORRECTION

PATENT NO. : 5,473,780
DATED : December 12, 1995
INVENTOR(S) : SuZen

It is certified that error appears in the above-identified patent and that said Letters Patent is hereby corrected as shown below:

On the title page, under item [19] "Zen" should read --SuZen--.
On the title page, item [76], "Su Zen" should read --SuZen--.

Signed and Sealed this

Seventeenth Day of November, 1998

*Attest:*

BRUCE LEHMAN

*Attesting Officer*

*Commissioner of Patents and Trademarks*